US007674969B2

(12) United States Patent
Xu et al.

(10) Patent No.: US 7,674,969 B2
(45) Date of Patent: Mar. 9, 2010

(54) FINGER MUSICAL INSTRUMENT

(75) Inventors: Keduan Xu, Shenzhen (CN); Xiangyang Han, Shenzhen (CN)

(73) Assignee: Ringsun (Shenzhen) Industrial Limited, Shenzhen, Guangdong Province (CN)

( * ) Notice: Subject to any disclaimer, the term of this patent is extended or adjusted under 35 U.S.C. 154(b) by 0 days.

(21) Appl. No.: 12/068,934

(22) Filed: Feb. 13, 2008

(65) Prior Publication Data

US 2009/0126554 A1 May 21, 2009

(30) Foreign Application Priority Data

Nov. 19, 2007 (CN) ..... 2007 1 0124612

(51) Int. Cl.
*G10H 1/00* (2006.01)

(52) U.S. Cl. ..... 84/615; 84/653; 84/658; 84/678; 84/687

(58) Field of Classification Search ..... 84/615, 84/653, 658, 678, 687
See application file for complete search history.

(56) References Cited

U.S. PATENT DOCUMENTS 2,780,954 A * 2/1957 Bryce ..... 84/375
4,635,516 A * 1/1987 Giannini ..... 84/600
4,860,364 A * 8/1989 Giannini ..... 381/333
4,905,560 A * 3/1990 Suzuki et al. ..... 84/600
4,920,848 A * 5/1990 Suzuki ..... 84/600
5,005,460 A * 4/1991 Suzuki et al. ..... 84/600
5,025,705 A * 6/1991 Raskin ..... 84/743
5,029,508 A * 7/1991 Suzuki et al. ..... 84/616
5,046,394 A * 9/1991 Suzuki et al. ..... 84/600
5,119,709 A * 6/1992 Suzuki et al. ..... 84/600
5,125,313 A * 6/1992 Hiyoshi et al. ..... 84/600
5,127,301 A * 7/1992 Suzuki et al. ..... 84/600
5,151,553 A * 9/1992 Suzuki et al. ..... 84/600

(Continued)

FOREIGN PATENT DOCUMENTS

CN 2213988 Y 11/1995

(Continued)

*Primary Examiner*—David S. Warren
(74) *Attorney, Agent, or Firm*—Jacobson Holman PLLC

(57) ABSTRACT

The present invention relates to a finger musical instrument, including a first glove and a second glove, some performance keys distributed on a fingertip of each of the gloves, and a sound box positioned at each of the gloves. The finger musical instrument further includes a combination key positioned at palm heel of each of the gloves. Each of the sound boxes is connected with a controller. The performance key and the combination key on the same glove are all connected with the corresponding controller. Therein the performance key and the combination of the performance key and the combination key of one glove gives out one octave sound, while the performance key and the combination of the performance key and the combination key of the other glove gives out another octave sound. Each of the controllers is provided with a range regulation switch used for making a sound higher or lower by an octave on each of the gloves. With regulation of the range regulation switch, the finger musical instrument is able to give out a range of two octaves through the sound box. The finger musical instrument of the present invention covers a range of three octaves and can exhibit a vivider music, and the controller can switch between a performance mode and a teaching mode, thus enhancing interaction between the finger musical instrument and a performer.

9 Claims, 2 Drawing Sheets

U.S. PATENT DOCUMENTS 5,166,462 A * 11/1992 Suzuki et al. ..... 84/600
5,166,463 A * 11/1992 Weber ..... 84/600
5,216,193 A * 6/1993 Masubuchi ..... 84/600
5,290,964 A * 3/1994 Hiyoshi et al. ..... 84/600
D347,853 S * 6/1994 Masubuchi et al. ..... D17/99
D348,282 S * 6/1994 Masubuchi ..... D17/99
5,338,891 A * 8/1994 Masubuchi et al. ..... 84/600
5,512,703 A * 4/1996 Usa ..... 84/600
5,571,020 A * 11/1996 Troudet ..... 434/233
5,581,484 A * 12/1996 Prince ..... 702/150
5,638,767 A * 6/1997 Bush ..... 116/139
6,262,355 B1 * 7/2001 Koch ..... 84/600
6,420,640 B2 * 7/2002 Koch ..... 84/600
7,038,122 B2 * 5/2006 Nishitani et al. ..... 84/723
7,038,575 B1 * 5/2006 Frohman et al. ..... 340/384.7
7,378,585 B2 * 5/2008 McGregor ..... 84/600
7,381,884 B1 * 6/2008 Atakhanian ..... 84/723
2001/0032538 A1 * 10/2001 Koch ..... 84/477 R
2002/0166438 A1 * 11/2002 Nishitani et al. ..... 84/600
2004/0112204 A1 * 6/2004 Javelle ..... 84/645
2004/0244564 A1 * 12/2004 McGregor ..... 84/478
2005/0252364 A1 * 11/2005 O'Modhrain et al. ..... 84/737
2006/0101988 A1 * 5/2006 Aldridge ..... 84/733
2006/0107826 A1 * 5/2006 Knapp et al. ..... 84/724
2006/0137511 A1 * 6/2006 McGregor ..... 84/478
2006/0207409 A1 * 9/2006 Kavana ..... 84/600
2006/0249008 A1 * 11/2006 Luther ..... 84/602
2006/0288842 A1 * 12/2006 Sitrick et al. ..... 84/477 R
2007/0256551 A1 * 11/2007 Knapp et al. ..... 84/722
2007/0272070 A1 * 11/2007 McGinnis, II ..... 84/378
2009/0019988 A1 * 1/2009 Lombardi ..... 84/470 R

FOREIGN PATENT DOCUMENTS

GB 2221557 * 7/1990

* cited by examiner

FINGER MUSICAL INSTRUMENT

FIELD OF THE INVENTION

The present invention relates to a toy, and particularly to a musical toy that has a musical performance function.

BACKGROUND OF THE INVENTION

Traditional toys, such as animal toys or jigsaws, all attract children through their appearances. This kind of toys that cannot train brains can neither interest children in studying music nor have interaction with children.

If children want to study music, such musical instruments as an electronic organ or a piano have to be purchased for them. However, these musical instruments cannot be taken, and too early to study vocality is very likely to lower children's interest in studying music. Therefore, a finger musical instrument easy to take and use emerges as the times require.

A musical glove is disclosed in Chinese Patent ZL92234332.2 (CN2213988Y). The musical glove, in combination with a traditional glove mainly for keeping warm, provides a finger musical instrument easy to take and a possibility for a real time performance.

However, a traditional finger musical instrument can only give out a sound of the scale corresponding to a fingertip performance. It has a very narrow range, and cannot exhibit a vivider music. Besides, there is also a lack of interaction between the finger musical instrument and a performer. Therefore, it limits promotion of the finger musical instrument.

Hence, a new finger musical instrument is strongly desired that can resolve the above-mentioned problems with the tradition finger musical instrument.

CONTENTS OF THE INVENTION

A purpose of the present invention is to provide a finger musical instrument with a wider range to overcome the above-mentioned shortcomings of the prior art.

Another purpose of the present invention is to provide a finger musical instrument with a better interaction and a stronger function.

In order to attain the above-mentioned purposes, a technical solution of the present invention is as below: A finger musical instrument is provided, which includes a first glove and a second glove, some performance keys distributed on a fingertip of each of the gloves, and a sound box positioned at each of the gloves. It is characterized in that the finger musical instrument further includes a combination key positioned at palm heel of each of the gloves, a pair of controllers, and a pair of range selection switches used for making a sound higher or lower by an octave. Each of the sound boxes is connected with one of the controllers. The performance key and the combination key on the same glove are all connected with the corresponding controller. Each of the controllers is connected with one of the range selection switches. The performance key and the combination of the performance key and the combination key on the first glove, under selection control of the range selection switch on this glove, make the corresponding sound box give out a sound in the octave bass range or the octave mediant range. The performance key and the combination of the performance key and the combination key on the second glove, under selection control of the range selection switch on this glove, make the corresponding sound box give out a sound in the octave mediant range or the octave alt range.

Preferably, the sound box is further provided with a switchover switch connected with the controller; the switchover switch sets the controller under a performance mode or a teaching mode; the performance keys are the performance keys ($K_1$-$K_{10}$) distributed at the ten fingertips of the gloves, respectively; and the combination keys are a first and a second combination keys ($K_A$ and $K_B$) positioned at palm heel of the two gloves, respectively.

The switchover switch sets the controller under the performance mode. The controller, according to selection of the range regulation switch, collects an input signal of the performance key and the combination key, and performs the octave bass and the octave mediant or performs the octave mediant and the octave alt.

To be specific, when the range regulation switch selects to perform the octave bass and the octave mediant, the pair of gloves represents the following scales, respectively: The first glove: each performance key ($K_1$-$K_5$) respectively gives out the sound of the note names of 'c', 'd', 'e', 'f' and 'g', a first of the performance keys ($K_1$-$K_5$) of the first glove giving out the sound of the note name 'a' in combination with the first combination key $K_A$, a second of the performance keys ($K_1$-$K_5$) of the first glove giving out the sound of—the note name 'b' in combination with the first combination key $K_A$, a third of the performance keys ($K_1$-$K_5$) of the first glove giving out the sound of the note name '$c^1$' in combination with the first combination key $K_A$; and the second glove: each performance key ($K_6$-$K_{10}$) respectively gives out the sound of the note names of '$c^1$', '$d^1$', '$e^1$', '$f^1$' and '$g^1$', therein a first of the performance keys ($K_6$-$K_{10}$) of the second glove gives out the sound of the note name '$a^1$' in combination with the second combination key $K_B$, a second of the performance keys ($K_6$-$K_{10}$) of the second glove the sound of the note name '$b^1$' in combination with the second combination key $K_B$, and a third of the performance keys ($K_6$-$K_{10}$) of the second glove the sound of the note name '$c^2$' in combination with the second combination key $K_B$. When the range regulation switch performs the octave mediant and the octave alt, the pair of gloves represents the following scales: The first glove: each performance key ($K_1$-$K_5$) respectively gives out the sound of the note names of '$c^1$', '$d^1$', '$e^1$', '$f^1$' and '$g^1$', a first of the performance keys ($K_1$-$K_5$) of the first glove giving out the sound of the note name '$a^1$' in combination with the first combination key $K_A$, a second of the performance keys ($K_1$-$K_5$) of the first glove giving out the sound of the note name '$b^1$' in combination with the first combination key $K_A$, a third of the performance keys ($K_1$-$K_5$) of the first glove giving out the sound of the note name '$c^2$' in combination with the first combination key $K_A$; and the second glove: each performance key ($K_6$-$K_{10}$) respectively gives out the sound of the note names of '$c^2$', '$d^2$', '$e^2$', '$f^2$' and '$g^2$', a first of the performance keys ($K_6$-$K_{10}$) of the second glove giving out the sound of the note name '$a^2$' in combination with the second combination key $K_B$, a second of the performance keys ($K_6$-$K_{10}$) of the second glove giving out the sound of the note name '$b^2$' in combination with the second combination key $K_B$, a third of the performance keys ($K_6$-$K_{10}$) of the second glove giving out the sound of the note name '$c^3$' in combination with the second combination key $K_B$.

Preferably, the switchover switch sets the controller under the teaching mode; the sound box plays an accompanying sound under control of the controller; and the controller can be activated to play a principal tone when any of the performance keys ($K_1$, $K_2$, $K_3$, $K_4$, $K_5$, $K_6$, $K_7$, $K_8$, $K_9$ and $K_{10}$) is pressed, a note of one principal tone being played by one press until end of a melody.

The melody is divided into several fragments by the controller. The controller plays an accompanying sound of a next fragment automatically when the principal tone has a rhythm in concert with the accompanying sound. The controller repeats the accompanying sound of the same fragment when the principal tone is not in concert with the accompanying sound.

Preferably, the controller and the performance key as well as the controller and the combination key are connected through a soft circuit board.

The sound box further includes a housing, a speaker connected with the controller for giving out a sound and a battery as a power supply for the controller and the speaker.

Following beneficial technical effects can be obtained by the technical solution of the present invention: 1) In the finger musical instrument of the present invention, the controller gives out two octaves each time and realizes a range of three octaves altogether according to the performance key touched by a performer or a signal of combination of the performance key and the combination key, enriching range and tone color of the finger musical instrument and exhibiting vivider music. 2) In the finger musical instrument of the present invention, the performance mode of the finger musical instrument is regulated through the controller, thus expanding range of the finger musical instrument. 3) In the finger musical instrument of the present invention, the teaching mode of the finger musical instrument is realized through the controller, making the finger musical instrument divide the melody into several fragments; the controller plays an accompanying sound of a next fragment automatically when the principal tone has a rhythm in concert with the accompanying sound, while the controller repeats the accompanying sound of the same fragment when the principal tone is not in concert with the accompanying sound; therefore, interaction between the finger musical instrument and a performer is enhanced. 4) In the finger musical instrument of the present invention, the controller and the performance key as well as the controller and the combination key are connected through a soft circuit board, thus making the finger musical instrument lighter and thinner.

DETAILED DESCRIPTION OF THE EMBODIMENTS

Figure 1:
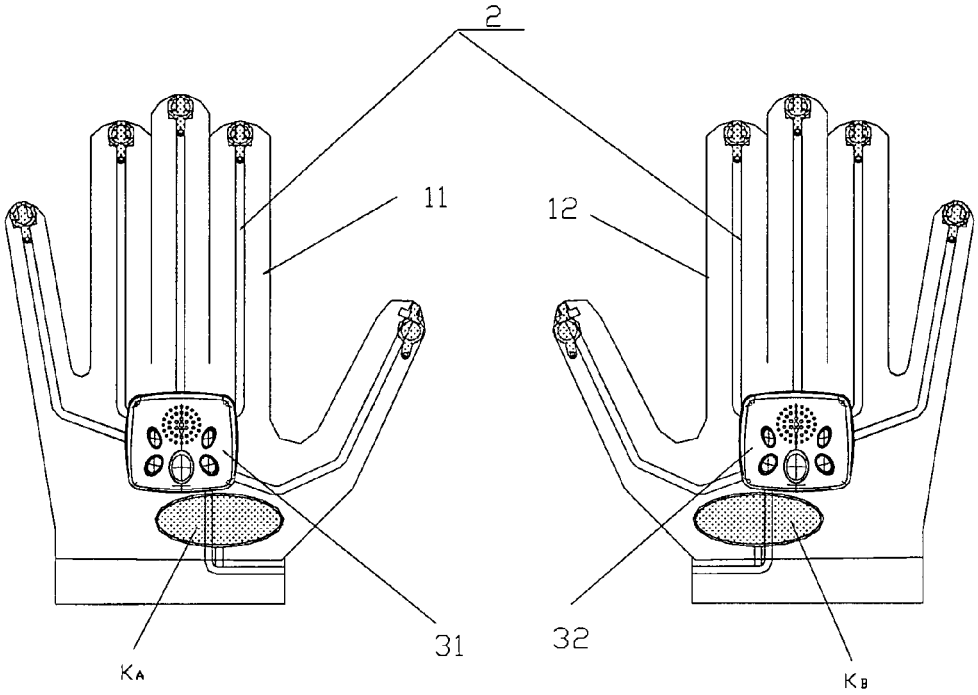
FIG. 1 is a structural schematic view of the finger musical instrument of the present invention.
Figure 2:
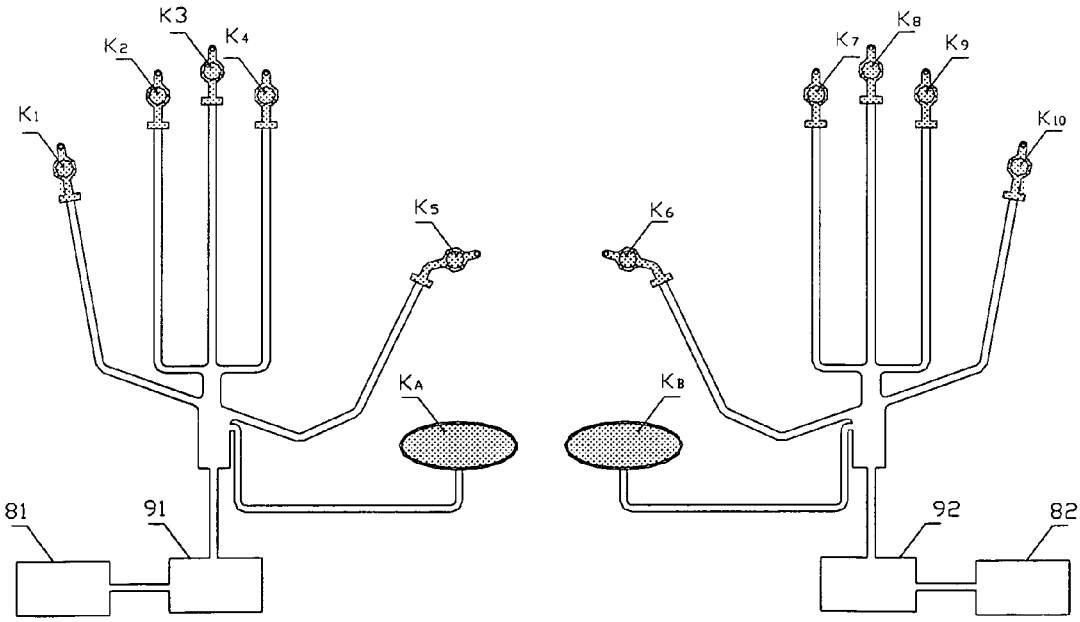
FIG. 2 is a structural schematic view of the circuit of the finger musical instrument of the present invention.
Figure 3:
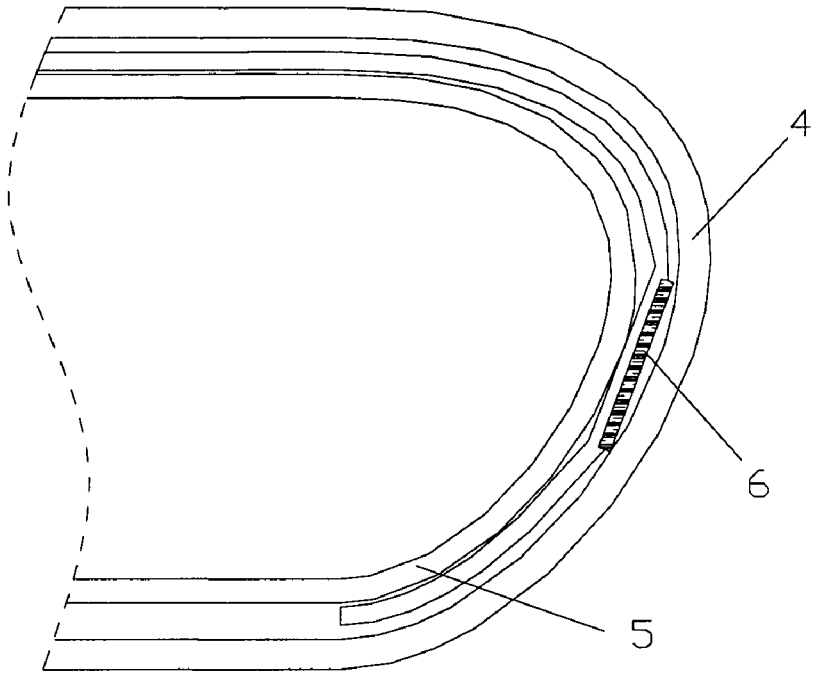
FIG. 3 is a layered structural drawing of the glove of the finger musical instrument of the present invention.

The present invention will be further described below through embodiments in combination with drawings.

Referring to FIGS. 1 to 4, the present invention relates to a finger musical instrument, including a first glove and a second glove (11 and 12), some performance keys ($K_1$-$K_{10}$) distributed on a fingertip of each of the gloves, a first and a second combination keys ($K_A$ and $K_B$) positioned at palm heel of the glove, and a sound box (31, 32) positioned at the back of the glove. The first sound box 31 is connected with the first controller 91, and the second sound box 32 with the second controller 92. The performance keys ($K_1$-$K_5$) and the combination key $K_A$ on the same glove 11 are all connected with the first controller 91, while the performance keys ($K_6$-$K_{10}$) and the combination key $K_B$ on the same glove 12 with the second controller 92.

The first glove and the second glove (11 and 12) are all layered, including an outside layer 4 of the glove and an inside layer 5 of the glove. The performance keys ($K_1$-$K_{10}$) are located between the outside layer 4 of the glove and the inside layer 5 of the glove. A keypad 6 of each of the performance keys ($K_1$-$K_{10}$) is distributed at the fingertip of the two gloves (11 and 12), referring to FIG. 3. While the first and the second combination keys ($K_A$ and $K_B$) are distributed at palm heel of the two gloves (11 and 12). The performance keys ($K_1$-$K_{10}$) include two conductive slices and a flexible insulator. When the performance keys ($K_1$-$K_{10}$) are pressed, the flexible insulator is transformed, and the two conductive slices contact and conduct electricity and transfer a performance signal toward the controller.

Figure 4:
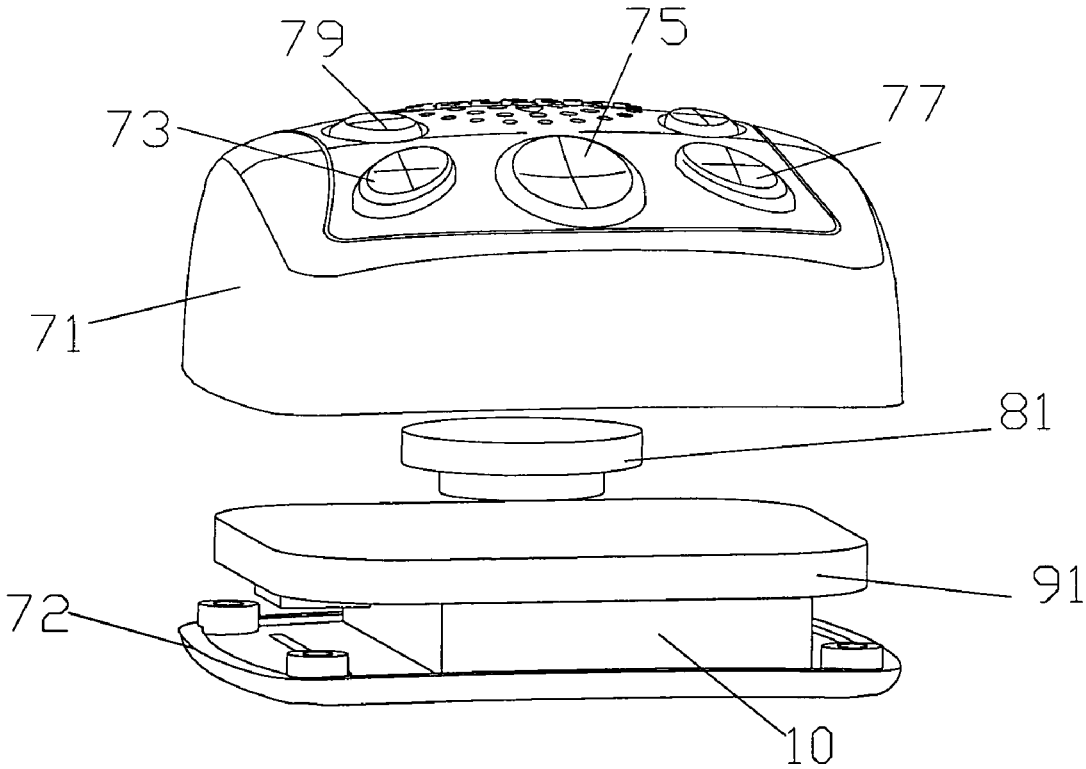
FIG. 4 is a structural exploded view of the sound box of the finger musical instrument of the present invention.

Referring to FIG. 4, each of the sound boxes, here taking the first sound box 31 as an example, includes a base 72 and a top cover 71 locked together, a speaker 81 connected with the controller for giving out a sound, and a battery 10 acting as a power supply for the controller 91 and the speaker 81. The top cover 71 is further provided with some buttons and control switches, including a range regulation switch 79 connected with the controller 91, a switchover switch 75 connected with the controller 91, a stop button 73 (STOP), a volume regulation button 77 (VOL+, VOL−), a key for replacing a paradigm music (DEMO), a key for replacing an accompanying music (RHYTHM), etc. The switchover switch 75 sets the controller 91 under the performance mode or the teaching mode. Each of the buttons is connected with the corresponding controller 91.

In this embodiment, the controllers (91 and 92) and the performance keys ($K_1$-$K_{10}$) as well as the controllers (91 and 92) and the combination keys ($K_A$ and $K_B$) are connected through a soft circuit board, thus making the finger musical instrument lighter and thinner.

The controller of the present invention can switch between the performance mode and the teaching mode under the function of the switchover switch.

Under the performance mode, the controllers (91 and 92) give out two octaves each time and realize a range of three octaves altogether according to selection of the range regulation switch 79, and the performance keys ($K_1$-$K_{10}$) touched by a performer, or a signal of combination of the performance key ($K_1$-$K_{10}$) and the first and the second combination key ($K_A$ and $K_B$).

To be specific, when the range regulation switch 79 selects to perform the octave bass and the octave mediant, the controllers (91 and 92) on the first glove 11 and the second glove 12 accept a signal from the performance keys ($K_1$-$K_{10}$) touched by the performer and the first and the second combination keys ($K_A$ and $K_B$), and can perform an octave bass and an octave mediant.

The scales represented by ten fingers of the first and the second gloves (11 and 12) are as below, respectively: the note names of 'c', 'd', 'e', 'f', 'g', '$c^1$', '$d^1$', '$e^1$', '$f^1$' and '$g^1$'. The performance key $K_2$ gives out the sound of the note name 'a' in combination with the first combination key $K_A$. The performance key $K_3$ gives out the sound of the note name 'b' in combination with the first combination key $K_A$. The performance key $K_4$ gives out the sound of the note name '$c^1$' in combination with the first combination key $K_A$. The performance key $K_7$ gives out the sound of the note name '$a^1$' in combination with the second combination key $K_B$. The performance key $K_8$ gives out the sound of the note name '$b^1$' in combination with the second combination key $K_B$. The performance key $K_9$ gives out the sound of the note name '$c^2$' in combination with the second combination key $K_B$.

On the other hand, when the range regulation switch 79 selects to perform the octave mediant and the octave alt, the controllers (91 and 92) on the first glove 11 and the second glove 12 accept a signal from the performance keys ($K_1$-$K_{10}$) touched by the performer and the first and the second combination keys ($K_A$ and $K_B$), and perform the octave mediant and the octave alt.

To be specific, the scales represented by ten fingers of the first and the second gloves (11 and 12) are as below, respectively: the note names of '$c^1$', '$d^1$', '$c^1$', '$f^1$', '$g^1$', '$c^2$', '$d^2$', '$e^2$', '$f^2$', and '$g^2$'. The performance key $K_2$ gives out the sound of the note name '$a^1$' in combination with the first combination key $K_A$. The performance key $K_3$ gives out the sound of the note name '$b^1$' in combination with the first combination key $K_A$. The performance key $K_4$ gives out the sound of the note name '$c^2$' in combination with the first combination key $K_A$. The performance key $K_7$ gives out the sound of the note name '$a^2$' in combination with the second combination key $K_B$. The performance key $K_8$ gives out the sound of the note name '$b^2$' in combination with the second combination key $K_B$. The performance key $K_9$ gives out the sound of the note name '$c^3$' in combination with the second combination key $K_B$.

The controllers (91 and 92) play an accompanying sound under the teaching mode. Meanwhile, when any of the performance keys ($K_1$, $K_2$, $K_3$, $K_4$, $K_5$, $K_6$, $K_7$, $K_8$, $K_9$ and $K_{10}$) is pressed and a performance signal is feedbacked to the controller (91, 92), the controllers (91 and 92) play a principal tone corresponding to the performance, a note of one principal tone being played each time until end of a melody.

The melody is divided into several fragments by the controller under the teaching mode. A performance signal of a performer is transferred to the controllers (91 and 92). Meanwhile the controller determines whether the principal tone the performer performs is in concert with rhythm of the accompanying sound. The controllers (91 and 92) play a companion sound of a next fragment automatically when the principal tone has a rhythm in concert with the companion sound. The controllers (91 and 92) repeat the companion sound of the same fragment when the principal tone is not in concert with the companion sound.

The preferred embodiments of the present invention are described in detail above. It should be understood however that many modifications and adaptations of the basic invention concept described here that are apparent to those skilled in the art all fall within the spirit and scope of the invention defined by the attached claims.

What is claimed is:

1. A finger musical instrument, comprising:

a first glove and a second glove, some performance keys distributed on a fingertip of each of the gloves, and a sound box positioned at each of the gloves;

wherein:

the finger musical instrument further comprises a combination key positioned at palm heel of each of the gloves, a pair of controllers, and a pair of range selection switches used for making a sound higher or lower by an octave;

each of the sound boxes is connected with one of the controllers;

the performance key and the combination key on the same glove are all connected with the corresponding controller;

each of the controllers is connected with one of the range selection switches;

the performance key and the combination of the performance key and the combination key on the first glove, under selection control of the range selection switch on this glove, make the corresponding sound box give out a sound in the octave bass range or the octave mediant range;

the performance key and the combination of the performance key and the combination key on the second glove, under selection control of the range selection switch on this glove, make the corresponding sound box give out a sound in the octave mediant range or the octave alto range; and the sound box is further provided with a switchover switch connected with the controller, the switchover switch setting the controller under a performance mode or a teaching mode;

the performance keys are the performance keys (K1-K10) distributed at the ten fingertips of the gloves, respectively;

the combination keys are a first and a second combination keys (KA and KB) positioned at palm heel of the two gloves, respectively;

the switchover switch sets the controller under the teaching mode;

the sound box plays an accompanying sound under control of the controller; and the controller can be activated to play a leading tone according to any of the performance keys ($K_1$, $K_2$, $K_3$, $K_4$, $K_5$, $K_6$, $K_7$, $K_8$, $K_9$, and $K_{10}$) pressed, the leading tone being played by finger press until end of a melody;

wherein the melody is divided into several fragments by the controller, the controller playing an accompanying sound of a next fragment automatically when the leading tone is in consistency with the accompanying sound, the controller repeating the accompanying sound of the same fragment when the leading tone is not in consistency with the accompanying sound.

2. The finger musical instrument according to claim 1, wherein:

the switchover switch sets the controller under the performance mode; and the controller, according to selection of the range regulation switch, collects an input signal of the performance key and the combination key, and performs the octave bass and the octave mediant or performs the octave mediant and the octave alto.

3. The finger musical instrument according to claim 2, wherein:

when the range regulation switch selects to perform the octave bass and the octave mediant, the pair of gloves represents the following scales, respectively:

the first glove: each performance key ($K_1$-$K_5$) respectively gives out the sound of the note names of 'c', 'd', 'e', 'f', and 'g', a first of the performance keys ($K_1$-$K_5$) of the first glove giving out the sound of the note name 'a' in combination with the first combination key $K_A$, a second of the performance keys ($K_1$-$K_5$) of the first glove giving out the sound of the note name 'b' in combination with the first combination key $K_A$, a third of the performance keys ($K_1$-$K_5$) of the first glove giving out the sound of the note name '$c^1$' in combination with the first combination key $K_A$; and the second glove: each performance key ($K_6$-$K_{10}$) respectively gives out the sound of the note names of '$c^1$', '$d^1$', '$e^1$', '$f^1$' and '$g^1$', a first of the performance keys ($K_6$-$K_{10}$) of the second glove giving out the sound of the note name '$a^1$' in combination with the second combination key $K_B$, a second of the performance keys ($K_6$-$K_{10}$) of the second glove giving out the sound of the note name '$b^1$' in combination with the second combination key $K_B$, a third of the performance keys ($K_6$-$K_{10}$) of the second glove giving out the sound of the note name '$c^2$', in combination with the second combination key $K_B$;

when the range regulation switch performs the octave mediant and the octave alt, the pair of gloves represents the following scales, respectively:

the first glove: each performance key ($K_1$-$K_5$) respectively gives out the sound of the note names of '$c^1$', '$d^1$', '$e^1$', '$f^1$' and '$g^1$', a first of the performance keys ($K_1$-$K_5$) of the first glove giving out the sound of the note names '$a^1$' in combination with the first combination key $K_A$, a second of the performance keys ($K_1$-$K_5$) of the first glove giving out the sound of the note name '$b^1$' in combination with the first combination key $K_A$, a third of the performance keys ($K_1$-$K_5$) of the first glove giving out the sound of the note name '$c^2$' in combination with the first combination key $K_A$; and the second glove: each performance key ($K_6$-$K_{10}$) respectively gives out the sound of the note names of '$c^2$', '$d^2$', '$e^2$', '$f^2$', and '$g^2$', a first of the performance keys ($K_6$-$K_{10}$) of the second glove giving out the sound of the note name '$a^2$' in combination with the second combination key $K_B$, a second of the performance keys ($K_6$-$K_{10}$) of the second glove giving out the sound of the note name '$b^2$' in combination with the second combination key $K_B$, a third of the performance keys ($K_6$-$K_{10}$) of the second glove giving out the sound of the note name '$c^3$' in combination with the second combination key $K_B$.

4. The finger musical instrument according to claim 3, wherein the controller and the performance key as well as the controller and the combination key are connected through a soft circuit board.

5. The finger musical instrument according to claim 4, wherein the sound box further includes a housing, a speaker connected with the controller for giving out a sound and a battery as a power supply for the controller and the speaker.

6. The finger musical instrument according to claim 1, wherein the controller and the performance key as well as the controller and the combination key are connected through a soft circuit board.

7. The finger musical instrument according to claim 6, wherein the sound box further includes a housing, a speaker connected with the controller for giving out a sound and a battery as a power supply for the controller and the speaker.

8. The finger musical instrument according to claim 1, wherein the controller and the performance key as well as the controller and the combination key are connected through a soft circuit board.

9. The finger musical instrument according to claim 8, wherein the sound box further includes a housing, a speaker connected with the controller for giving out a sound and a battery as a power supply for the controller and the speaker.

* * * * *